US005882830A

United States Patent [19]

Visser et al.

[11] Patent Number: 5,882,830

[45] Date of Patent: Mar. 16, 1999

[54] PHOTOCONDUCTIVE ELEMENTS HAVING MULTILAYER PROTECTIVE OVERCOATS

[75] Inventors: Susan A. Visser, Rochester; Robin J. Cowdery-Corvan, Webster; David S. Weiss, Rochester, all of N.Y.

[73] Assignee: Eastman Kodak Company, Rochester, N.Y.

[21] Appl. No.: 70,544

[22] Filed: Apr. 30, 1998

[51] Int. Cl.[6] ..... G03G 5/047; G03G 5/147

[52] U.S. Cl. ..... 430/59; 430/58; 430/66; 430/67; 430/128; 430/132

[58] Field of Search ..... 430/58, 59, 66, 430/67, 128, 132

[56] References Cited

U.S. PATENT DOCUMENTS

| | | | |
|---|---|---|---|
| 3,615,414 | 10/1971 | Light | 430/74 |
| 3,732,180 | 5/1973 | Gramza et al. . | |
| 4,082,551 | 4/1978 | Steklenski et al. | 428/420 |
| 4,175,960 | 11/1979 | Berwick et al. | 430/58 |
| 4,886,722 | 12/1989 | Law et al. | 430/59 |
| 5,202,207 | 4/1993 | Kanemaru et al. | 430/59 |
| 5,324,605 | 6/1994 | Ono et al. | 430/59 |
| 5,330,865 | 7/1994 | Leus et al. | 430/59 |
| 5,332,635 | 7/1994 | Tanaka | 430/96 |
| 5,561,021 | 10/1996 | Yamazaki et al. | 430/132 |
| 5,614,342 | 3/1997 | Molaire et al. | 430/78 |

OTHER PUBLICATIONS

D. S. Weiss et al., *Analysis of Electrostatic Latent Image Blurring Caused by Photoreceptor Surface Treatments,* 1995, pp. 57–59.

*Primary Examiner*—Roland Martin
*Attorney, Agent, or Firm*—Doreen M. Wells

[57] ABSTRACT

A photoconductive element comprising: an electrically conductive base; at least one active layer comprising an organic material, said at least one active layer being capable of charge generation and charge transport; and an outermost multilayer protective overcoat comprising at least one sol-gel layer and at least one outermost diamond-like carbon layer comprising fluorine.

19 Claims, No Drawings

PHOTOCONDUCTIVE ELEMENTS HAVING MULTILAYER PROTECTIVE OVERCOATS

FIELD OF THE INVENTION

The present invention relates to electrophotographic elements. More particularly, it relates to electrophotographic elements having at least two protective layers of at least two different materials.

BACKGROUND OF THE INVENTION

Electrophotographic imaging processes and techniques have been extensively described in patents and other literature. The initial image forming step in the electrophotographic process cycle is the creation of an electrostatic latent image on the surface of a photoconductive element. This can be accomplished by charging the photoconductive element in the dark, such as through use of a corona or biased roller charging element. An electrostatic latent image is then formed by image-wise exposing the photoconductive element either optically or by electronic means, such as a laser or an array of light-emitting diodes. The image exposure creates free electron-hole pairs which migrate through the photoconductive element under the influence of the electric field. In such a manner, the surface charge is dissipated in the exposed regions, thus creating an electrostatic charge pattern. A visible image is then formed by depositing electrophotographic toner, comprised of electrically charged marking particles, onto the electrostatic latent image during a development step.

Two methods of development are used in electrophotography: discharged area development (DAD) and charged area development (CAD). The former uses toner of the same polarity as the surface charge on the photoconductive element. The latter utilizes toner of polarity opposite to the polarity of the charge on the element. CAD is widely used in optical copiers, while DAD is more desirable for digital applications.

The image formed in the development step is transferred to a suitable receiver, such as transparency stock or paper. It can be transferred to a receiver directly, with the assistance of, for example, an electric field or through the application of heat, pressure, or heat and pressure. Alternatively, the image can be first transferred to an intermediate member and, subsequently, transferred to the receiver. Color images can be made by transferring images comprised of the primary colors, (e.g. cyan, magenta, yellow, and black) in register, to either the receiver or the intermediate member.

After transfer, the image is permanently fused to the receiver via a suitable fusing process. In preparation for the next electrophotographic cycle, the photoconductive element is typically cleaned of residual toner because the transfer step is not 100% efficient. Cleaning efficiency is increased by electrostatically conditioning the photoconductive element and residual toner with a charging element known as a pre-clean charger. Cleaning by any of a number of methods known to one skilled in the art is then performed.

Photoconductive elements, also called photoreceptors, are composed of an electrically conductive base and at least one active layer which is insulating in the dark but which becomes conductive upon exposure to light. The base may be in one of many forms, for example, a drum, a web or belt, or a plate. The photoreceptor can comprise one or multiple active layers. The active layer(s) typically contains one or more materials capable of the photogeneration of charge carriers (electrons or holes) and one or more materials capable of transport of the generated charge carriers.

Numerous materials have been described as being useful components of the photoconductive element. These include inorganic substances, such as selenium and zinc oxide, and organic compounds, both monomeric and polymeric, such as arylamines, arylmethanes, carbazoles, pyrroles, phthalocyanines, dye-polymer aggregates, and the like. Organic compounds are particularly useful for several reasons. They can be prepared as flexible layers; as such, the copier or printer architecture is not limited to a particular configuration. Organic compounds have spectral sensitivities that can extend throughout the visible and into the near infrared regions of the spectrum. Organic compounds are amenable to low cost large area manufacturing processes. Elements prepared from organic materials are known as organic photoconductors (OPCs).

OPCs can be prepared with single or multiple active layers. In most OPCs, charge transport occurs through movement of a single type of charge carrier, electrons or holes, but not both. When only one carrier is mobile, trapped carriers of opposite sign can be created, resulting in a change in sensitometry of the active layer and in a phenomenon known as latent image hysteresis. One solution to the problem of latent image hysteresis is to separate the charge generation and transport functions into separate layers, referred to as the charge generation (CGL) and charge transport (CTL) layers, to form a dual or multi-layer photoconductive element.

A problem associated with OPCs is that the lifetime of these elements is less than desired. Physical damage to the photoconductive element incurred during the electrophotographic process, from installation or other service procedures, or from foreign objects falling into the electrophotographic engine during normal use, can significantly reduce the lifetime of the element and will impart defects in the images produced. Such defects occur at random time intervals and cannot be treated at normal service intervals.

In order to address the issue of damage to the photoconductive element, protective layers such as sol-gel overcoats are often coated onto the photoconductive element. However, in order to be effective, the charge transport properties of such overcoats must be strictly controlled. If the material is too electrically insulating, it will not permit the photoconductive element to photodischarge. This will result in poor electrostatic latent image formation. Alternatively, if the layer is too conducting, the electrical charges forming the electrostatic latent image will spread prior to development. This effect, referred to as latent image spread (LIS), will result in a loss of resolution and blurring of the image. It is particularly problematic with high quality electrophotographic engines producing latent images requiring a resolution of 600 dpi or greater. For commonly used materials such as sol-gels, the electrical conductivity is generally controlled by the addition of ionic charge conducting agents to the sol-gel formulation. However, the resistivity of such materials is highly sensitive to the humidity and can be too resistive under some conditions and too conductive under others.

A further challenge in the design of protective layers is to maintain their flexibility when used on flexible substrates, such as photoconductor elements in a belt configuration. Belts are frequently used in high speed electrophotographic processes. The belts must frequently be bent around rollers or other elements that have a small radius. Thus, the photoconductive element must be able to withstand bending repeatedly over a small bending radius. A thick protective layer will crack or peel away from the photoconductive layers under these circumstances.

Further, sol-gel overcoats are limited in the amount of protection from physical damage that they can impart to a photoconductive element. The use of sol-gel layers on flexible substrates, such as photoconductive elements in a belt configuration, puts a particular limitation on the amount of abrasion resistance that a sol-gel coating can impart. The belts must frequently be bent around rollers or other elements that have a small radius. Thus, the photoconductive element must be able to withstand bending repeatedly over a small bending radius. A thick protective layer will crack or peel away from the photoconductive layers under these circumstances so that increasing the thickness of the sol-gel to increase its protective abilities is not a solution. Increasing the hardness of the sol-gel might improve abrasion resistance, but then the coating would not be flexible and would be subject to cracking and flaking from the layers it is designed to protect. Thus, it is not clear how the abrasion resistance of these materials could be improved or how the LIS problem could be eliminated.

Another type of protective overcoat used with OPCs is diamond-like carbon (DLC). Hotomi et al., in U.S. Pat. No. 4,965,156, discloses the use of two protective layers on an organic photoconductive element. The first layer is an amorphous carbon layer which includes more than 5 atomic percent fluorine. The second, outermost layer is a similar material except that the fluorine content must be lower than 5 atomic percent. Layer thicknesses disclosed are 0.01 to 4.0 $\mu$m for the first layer and 10 to about 400 angstroms (0.001 to about 0.04 $\mu$m) for the second layer. Hotomi et al. teach that if the fluorine content is above 5 atomic percent in the outermost layer, it causes image fogging. Fogging can be detected by measurements of latent image spread.

U.S. Pat. No. 5,525,447 to Ikuno et al. discloses an electrophotographic photoconductor with a surface protective layer formed on the photoconductive layer. The surface protective layer is a multi-layer or graduated layer structure having at least one additive element selected from the group consisting of nitrogen, fluorine, boron, phosphorous, chlorine, bromine, and iodine. The additive element is at a higher concentration near the surface of the protective layer than at the interface between the protective layer and the photoconductive layer. When the additive element is fluorine, the fluorine to carbon atomic ratio (F/C) of 0.001 or less in the vicinity of the photoconductive layer adjacent to the protective layer and of 0.005 or more in the vicinity of the top surface of the protective layer. The layer structure is used to improve adhesion of the protective layer to the photoconductive layer. It is disclosed that adhesion is poor if the multilayer or graduated layer structure is not used. Only single layer and dual layer photoconductive elements are disclosed. Thicknesses of the protective layers in the range of 0.5 to 5 $\mu$m are disclosed.

U.S. Pat. No. 4,882,256 to Osawa et al. discloses the use of a hydrogen-containing amorphous carbon overcoat layer containing one or more atoms selected from the group consisting of halogen, oxygen, and nitrogen. Oxygen concentrations in the overcoat layer of 0.1–3% are disclosed. Fluorine concentrations in the overcoat layer of 0.1–23% are disclosed. Single and dual layer photoconductive elements are disclosed.

U.S. patent application Ser. No. 08/639,374 to Visser et al. discloses the use of fluorinated diamond-like carbon outermost layers on organic photoconductive elements comprising charge transport layers containing arylamine. Fluorine concentrations of 25–65 atomic percent are claimed. Outermost layers of 0.05 to 0.5 $\mu$m thickness are claimed.

Each of the inventions discussed above has a limitation in the amount of protection that it can impart to an OPC. Thicker DLC layers cannot be used because the thicker coatings tend to flake off from the active layer of the OPC. Harder DLC layers cannot be used because the method by which increased hardness is achieved also results in increased stress in the layers; the increased stress results in flaking of the DLC layer from the active layer. Further, as taught by Hotomi et al. in U.S. Pat. No. 4,965,156, there are limitations in the type of DLC layers that may be used with OPCs to avoid getting LIS. Thus, it is not clear how to increase the protective ability of DLC layers. For long process lifetimes that are becoming a necessity for photoconductive elements in modern electrophotographic processes, however, increasing the level of protection for the active layers of an OPC is crucial.

Thus, there is a need to provide a protective overcoat which has improved protective properties and which reduces the amount of LIS seen with other protective coatings, such as sol-gels.

SUMMARY OF THE INVENTION

There is provided a photoconductive element having surprisingly increased abrasion resistance and surprisingly low latent image spread (LIS). The element of the invention overcomes the above-mentioned difficulties for elements having protective overcoats of sol-gel or DLC alone by using a multilayer protective overcoat comprising at least one sol-gel layer and at least one outermost DLC layer. The protective overcoat of this invention protects the photoconductive element from the deleterious effects of humidity and corona chemicals that give rise to LIS. Further, the present protective overcoat increases the abrasion resistance of the element to a much greater degree than would be expected from the addition of a DLC layer over a sol-gel layer. Thus, the multilayer protective overcoat has characteristics which are superior to either of the DLC or sol-gel layers when used singly.

The sol-gel layer thickness is 1–10 micrometers ($\mu$m), preferably 2–5 $\mu$m. When used with an outermost DLC layer, the sol-gel composition is not limited by the necessity to have low sensitivity to humidity and corona chemicals. The composition should be such that the physical characteristics, such as scratch resistance and flexibility, meet the electrophotographic process demands, and the conductivity is such that the time constant for decay of the surface potential is short compared to the process cycle time, but not so conductive as to cause objectionable image quality degradation due to lateral conductivity.

The fluorine content of the DLC layer can be between 0 and 65 atomic percent, preferably between 0 and 40 atomic percent, more preferably 0 and 20 atomic percent, most preferably less than 5 atomic percent, based on the composition of the DLC layer. The thickness of the DLC layer is preferably between about 0.05 and 2 $\mu$m, more preferably between about 0.05 and 0.5 $\mu$m, most preferably between about 0.15 and 0.35 $\mu$m.

DETAILED DESCRIPTION OF THE INVENTION

The photoconductive element of the present invention comprises an electrically conductive base, at least one active layer comprising an organic material, and an outermost multilayer protective overcoat, said overcoat comprising at least one sol-gel layer and at least one outermost diamond-like carbon (DLC) layer, said diamond-like carbon layer preferably comprising 0–65 atomic percent fluorine, based on the composition of the DLC layer. By "outermost"

layer(s) is meant the layer(s) farthest away from the electrically conductive base.

An electrically conductive base can comprise a substrate and, optionally, one or more additional layers. A substrate can be either flexible or rigid for use in, for example, either web or drum format. A substrate can be either electrically insulating or conducting. Suitable substrate materials include polymers such as poly(ethylene terphthalate), nylon, polycarbonate, poly(vinyl butyral), poly(ethylene), etc., as well as aluminum, stainless steel, ceramics, ceramers, etc. If the substrate material is electrically insulating, it should be coated by a suitable process such as evaporation, sputtering, painting, solvent coating, etc., with a conductive layer such as nickel, copper, gold, aluminum, chromium, or suitable conducting polymers. An electrically conductive substrate material alone or the combination of an insulating substrate and an electrically conductive layer shall be referred to herein as an electrically conductive base.

Electrically conductive bases include, for example, paper (equilibrated to a relative humidity above 50 percent); aluminum-paper laminates; metal foils such as aluminum, zinc, etc.; metal plates, such as aluminum, copper, zinc, brass and galvanized plates; vapor deposited metal layers such as silver, chromium, nickel, aluminum and the like coated on paper or conventional photographic film supports, such as cellulose acetate, polystyrene, poly(ethylene terephthalate), etc. Such conductive materials as chromium, aluminum, or nickel can be vacuum deposited on transparent film supports in sufficiently thin layers to allow photoconductive elements prepared therewith to be exposed from either side of such elements. The electrically conductive base can be fabricated in any suitable configuration, for example, as a sheet, a drum, or an endless belt. The electrically conductive portion of the base is always closest to the active layers of the photoconductive element.

The active layer or layers of the photoconductive elements of this invention comprise organic materials. In a photoconductive element containing a single active layer, charge generation and charge transport take place within the same layer. An example of organic materials useful for photoconductive elements containing a single active layer are aggregate photoconductive compositions. Single active layer aggregate photoconductive elements are described in Light, U.S. Pat. No. 3,615,414, and in Gramza et al., U.S. Pat. Nos. 3,732,180 and 3,615,415. For photoconductive element containing a single active layer, the thickness of the active layer may vary. A preferred thickness for the layer is from about 2 to about 50 $\mu$m. A more preferred range is from about 5 to about 20 $\mu$m.

The active layers in the elements of this invention may comprise multiple layers that are each capable of charge generation and charge transport, where, for example, each layer is sensitive to different wavelengths of light, or separate layers for each of the charge generation and charge transport functions. In the latter case, the active layers comprise one or more charge generation layers (CGL) and one or more charge transport layers (CTL). A CGL is designed primarily for the photogeneration of charge carriers. A CTL is designed primarily for the transport of the generated charge carriers. Photoconductive elements having one CGL and one CTL are sometimes referred to as dual layer photoconductive elements. Representative patents disclosing methods and materials for making photoconductive elements containing a CGL and/or a CTL include U.S. Pat. Nos. 5,614,342; 4,175,960 and 4,082,551. Photoconductive elements containing more than one CTL or CGL are also known. For example, U.S. Pat. No. 5,213,927 to Kan et al. discloses a photoconductive element containing two CGLs. Active layers comprising more than one CTL or CGL would be useful in the elements of this invention.

Each CTL contains, as the active charge transport material (CTM), one or more organic materials capable of accepting and transporting charge carriers generated in the CGL. Mixtures of two or more different CTMs can be used to improve the function of the element. Useful CTMs can generally be divided into two classes. That is, most CTMs generally will preferentially accept and transport either holes, or electrons generated in the CGL. Examples of CTMs that transport holes are arylamines. Examples of arylamines that can be used in the CTL of the photoconductive elements or methods of this invention include triphenylamine; tri-p-tolylamine; N-N'diphenyl-N,N'-bis(3-methylphenyl)-(1,1'-biphenyl)-4,4'diamine; 1,1-bis(di-4-tolylaminophenyl)cyclohexane; N,N',N",N"'-tetrakis(4-methylphenyl)-(1,1'-biphenyl)-4,4'-diamine; 4-(4-methoxystyryl)-4',4"-dimethoxytriphenylamine; N,N'-diphenyl-N,N'-di(m-tolyl)-p-benzidine; and mixtures of two or more of these CTMs. These and other useful organic CTMs are disclosed in U.S. Pat. Nos. 5,332,635; 5,324,605; and 5,202,207, incorporated herein by reference. Other useful hole transport materials include arylalkanes, hydrazones, and pyrazolines.

Examples of electron transport materials include diphenoquinones, charge-transfer complexes of poly(N-vinylcarbazole):2,4,7-trinitro-9-fluorenone, and 2,4,7-trinitro-9-fluorenone.

CTMs capable of transporting both electrons and holes are also known and useful in the elements of this invention. Such materials include N-[p-(di-p-tolylamino)phenyl]-N'-(1,2-dimethylpropyl)-1,4,5,8-naphthalenetetracarboxylic diimide (TAND), disclosed in the patent application filed concurrently herewith, entitled, "Bipolar Electrophotographic Elements", to S. A. Visser, P. M. Borsenberger, and J. E. Kaeding; and N,N-bis (p-(di-p-tolylamino) phenyl)-1,4,5,8-naphthalenetetracarboxylic acid, disclosed in the patent application filed concurrently herewith, entitled, "Bipolar Charge Transport Materials Useful In Electrophotography," to S. A. Visser, P. M. Borsenberger, J. E. Kaeding, and B. J. Murray.

In addition to one or more CTMs, the CTL may comprise one or more binder materials. The binder should provide little or no interference with the generation and transport of charges in the layer. The binder can also be selected to provide additional functions, such as improving adhesion to another layer or providing a smooth, easily cleaned, wear-resistant surface in a top layer. The binder can be one material or two or more different materials. Common binder types include styrene-butadiene copolymers; vinyl toluene-styrene copolymers; styrene-alkyd resins; silicone-alkyd resins; soya-alkyd resins; vinylidene chloride-vinylchloride copolymers; poly(vinylidene chloride); vinyldene chloride-acrylonitrile copolymers; vinyl acetate-vinyl chloride copolymers; poly(vinyl acetals), such as poly(vinyl butyral); nitrated polystyrene; poly(methylstyrene); polystyrene; isobutylene polymers; polyesters, such as poly{ethylene-co-alkylene bis(alkyleneoxyaryl) phenylenedicarboxylate}; phenol-formaldehyde resins; ketone resins; polyamides; polycarbonates; polythiocarbonates; copolymers of vinyl haloaclylates and vinyl acetate such as poly(vinyl-m-bromobenzoate-co-vinyl acetate); chlorinated poly(olefins), such as chlorinated poly(ethylene); cellulose derivatives such as cellulose acetate, cellulose acetate butyrate, and ethyl cellulose; and polyimides such as poly{1,1,3-trimethyl-3-(4'-phenyl)-5-indane pyromellitimide}. One group of polyester binders useful in a CTL is the subject of commonly assigned, co-pending U.S. Ser. No. 08/584,502, now U.S. Pat. No. 5,786,119, entitled ELECTROPHOTOGRAPHIC ELEMENTS HAVING CHARGE TRANSPORT LAYERS CONTAINING HIGH MOBILITY POLYESTER BINDERS of Sorriero, O'Regan and Borsenberger, filed on Jan. 11, 1996. The polyester binders have the following structural formula:

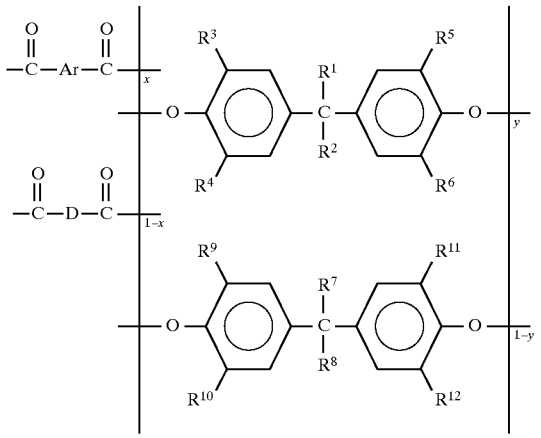

wherein:

Ar represents phenylene, terephthaloyl, isophthaloyl, 5-t-butyl-1,3-phenylene or phenylene indane;

D represents alkylene, linear or branched, or cycloalkylene, having from 4 to about 12 carbons;

$R^1$, $R^2$, $R^7$, and $R^8$ represent H, alkyl having 1 to 4 carbon atoms, cyclohexyl, norbornyl, phenylindanyl, perfluoralkyl having 1 to 4 carbon atoms, α, α-dihydrofluoroalkyl having 1 to 4 carbon atoms, or α, α, ω-hydrofluoroalkyl having 1 to 4 carbon atoms; and $R^3$, $R^4$, $R^5$, $R^6$, $R^9$, $R^{10}$, $R^{11}$, and $R^{12}$ represent H, halogen, or alkyl having from 1 to about 6 carbons; x is from 0 to 0.8; and y is from 0 to 1, with x and y being mole ratios.

The polyester binders can be prepared using well known solution polymerization techniques such as disclosed in W. Sorenson and T. Campbell, Preparative Methods of Polymer Chemistry, page 137, Interscience (1968). Schotten-Baumann conditions were employed to prepare the following examples of useful polyester binders: poly{4,4'-isopropylidene bisphenylene terephthalate-co-azelate (70/30)}; poly{4,4'-isopropylidene bisphenylene terephthalate-co-isophthalate-co-azelate (50/25/25)}; poly{4,4'-isopropylidene bisphenylene-co-4,4'-hexafluoroisopropylidene bisphenylene (75/25) terephthalate-co-azelate (65/35)}; poly{4,4'-isopropylidene bisphenylene-co-4,4'-hexafluroisopropylidene bisphenylene (50/50) terephthalate-co-azelate (65/35)}; poly{4,4'-hexafluoroisopropylidene bisphenylene terephthalate-co-azelate (65/35)}; poly{hexafluoroisopropylidene bisphenylene terephthalate-co-isophthalate-co-azelate (50/25/25)}; and poly{4,4'-isopropylidene bisphenylene isophthalate-co-azelate (50/50)}.

Examples of binder polymers which are particularly desirable from the viewpoint of minimizing interference with the generation or transport of charges include: bisphenol-A polycarbonates and polyesters such as poly[(4,4'-norbornylidene)diphenylene terephthalate-co-azelate]. Polyester ionomers are useful as well. Examples of such polyester ionomers include:

poly[1,4-cyclohexylenedimethylene-co-2,2'-oxydiethylene (46/54) isophthalate-co-5-sodiosulfoisophthalate (95/5)];

poly[1,4-cyclohexylenedimethylene-co-2,2'-oxydiethylene (46/54) isophthalate-co-5-sodiosulfoisophthalate (90/10)];

poly[1,4-cyclohexylenedimethylene-co-2,2'-oxydiethylene (46/54) isophthalate-co-5-sodiosulfoisophthalate (85/15)];

poly[1,4-cyclohexylenedimethylene-co-2,2'-oxydiethylene (46/54) isophthalate-co-5-sodiosulfoisophthalate (80/20)];

poly[1,4-cyclohexylenedimethylene-co-2,2'-oxydiethylene (46/54) isophthalate-co-5-sodiosulfoisophthalate (75/25)];

poly[1,4-cyclohexylenedimethylene-co-2,2'-oxydiethylene (46/54) isophthalate-co-5-lithiosulfoisophthalate (90/10)];

poly[1,4-cyclohexylenedimethylene-co-2,2'-oxydiethylene (46/54) isophthalate-co-triphenylmethylphosphoniumsulfoisophthalate (90/10)];

poly[1,4-cyclohexylenedimethylene-co-2,2'-oxydiethylene (46/54) isophthalate-co-5-(4-sulfophenoxy)isophthalate (90/10)];

poly[1,4-cyclohexyloxydiethylene terephthalate-co-4-(4-sulfophenoxy)isophthalate (70/30)]; and poly(1,4-cyclohexylenedimethylene-co-2,2'-oxydiethylene (46/54) isophthalate-co-4,4'-dicarboxyphenylmethylphenyl phosphonium p-toluenesulfonate (90/10)].

The thickness of the CTL may vary. A preferred thickness for the CTL is from about 2 to about 50 μm dry thickness. A more preferred range is from about 5 to about 30 μm.

Each CGL comprises a charge generation material (CGM). The CGM may comprise one or more dye-polymer aggregates, phthalocyanines, squaraines, perylenes, or azo-compounds. The CGLs may comprise a binder as described above; however, certain CGMs without a binder may be vacuum deposited to form a CGL. Examples of CGMs, useful binders and methods of preparing the CGL are disclosed in U.S. Pat. Nos. 4,886,722 to Law et al., 4,985,782 to Koyama et al, 5,330,865 to Leus et al, and 5,614,342 to Molaire et al, incorporated herein by reference. Examples of useful dye-polymer aggregates for use in the CGL are disclosed in U.S. Pat. Nos. 4,175,960 and 3,615,414, incorporated herein by reference. Additional CGMs and various sensitizing materials, such as spectral sensitizing dyes and chemical sensitizers may also be incorporated in each CGL.

The CGMs in each of the CGLs can be the same or different and can be chosen to be or can be combined with appropriate sensitizers in order to be sensitive to the same or different wavelengths of radiation. One or more CTMs can also be included in a charge generation layer. Examples of CTMs that are useful in CGLs include arylamines, particularly triarylamines, and polyarylalkanes, in particular 1,1-bis(di-4-tolylaminophenyl)-cyclohexane, and 4-N,N-(diethylamino)tetraphenylmethane. Different CTMs can be included in each of the CGLs of the photoconductive elements of this invention. For example, a triarylamine charge-transport material can be included in a first CGL and a polyarylalkane charge-transport material in a second CGL. Other pairs or sets of different materials could also be selected. CTMs in the CTL can be the same as or different from any of the CTMs in CGLs.

Useful binders in a CGL are known to a person of ordinary skill in the art as discussed above. The preferred binders are polycarbonates, for example Lexan™ available from General Electric, Makrolon™ available from Mobay, Inc., and poly(vinyl butyral).

The active layers, including CGLs and CTLs, in elements of the invention can optionally contain other addenda such as leveling agents, surfactants, crosslinking agents, colorants, antioxidants, plasticizers, sensitizers, contrast control agents, and release agents, as is well known in the art.

A useful thickness for each CGL is within the range of from about 0.1 to about 15 $\mu$m dry thickness, particularly from about 0.2 to about 5 $\mu$m.

The ordering of the CGLs and CTLs in the elements of this invention is not critical. A CGL may be between the electrically conductive base and a CTL, or a CTL may be between the electrically conductive base and a CGL. In some cases, it may be desirable to use one or more intermediate subbing layers or additional CTLs between the electrically conductive base and a CTL or a CGL, or between a CTL and a CGL to improve adhesion between each CTL, CGL, and the electrically conductive base.

In certain elements of this invention, it is also desirable to include an electrical barrier layer, also known as a charge injection blocking layer. This layer, situated between the electrically conductive base and the active layer or layers, is used to prevent injection of charge carriers from the conductive base into the layer carrying the charge generation function. When such injection occurs, surface charges on the photoconductive element are dissipated in unexposed areas of its surface. Barrier layers are well known in the art and are typically composed of thin polymeric layers. Useful barrier layer materials include polyamides and the aforementioned polyester ionomers. Diamond-like carbon barrier layers useful in the photoconductive elements of the invention are disclosed in co-pending U.S. Patent Application to Visser, Rimai, and Borsenberger, "Electrophotographic Elements Having DLC Charge-Injection Blocking Layers."

The barrier layer is coated directly on the electrically conductive base. Anodized aluminum substrates can serve as combined conductive base and barrier layer.

In one method of preparation of the photoconductive elements of the invention, the components of the active layer, including binder and any desired addenda, are dissolved or dispersed together in a solvent to form a coating composition which is then coated. The liquid is then caused to evaporate from the mixture to form the active layer.

Suitable organic solvents include aromatic hydrocarbons such as benzene, toluene, xylene and mesitylene; ketones such as acetone, butanone and 4-methyl-2-pentanone; halogenated hydrocarbons such as dichloromethane, 1,1,2-trichloroethane, chloroform and ethylene chloride; ethers including ethyl ether and cyclic ethers such as dioxane and tetrahydrofuran; other solvents such as acetonitrile and dimethylsulfoxide; and mixtures of such solvents. The amount of solvent used in forming the binder solution is typically in the range of from about 2 to about 100 parts of solvent per part of binder by weight, and preferably in the range of from about 10 to 50 parts of solvent per part of binder by weight.

In the preferred compositions, the optimum ratios of both CGM and CTM to binder may vary widely, depending on the particular materials employed. In general, useful results are obtained when the total concentration of both CGM and CTM in the layers is within the range of from about 0.01 to about 90 weight percent based on the dry weight of the layers. In a preferred embodiment of a photoconductive element of the invention, the coating composition contains from about 0 to about 40 weight percent of CTM and from 0.01 to about 80 weight percent of CGM based on the weight of the layer.

Another method for deposition of the active layer or layers is vacuum evaporation. It is possible to deposit only one of the layers by vacuum evaporation and the rest by coating from a solution or to deposit some fraction of the layers by vacuum evaporation and the rest by coating from a solution.

Photoconductive elements of the invention can include various additional layers known to be useful in electrophotographic elements, for example, subbing layers and screening layers.

The multilayer protective overcoat of the elements of this invention comprises at least one sol-gel layer and at least one outermost DLC layer. Sol-gels are materials for the production of glasses and ceramics by chemical means. Processing can be carried out at moderate temperatures making them useful for preparing organic-inorganic hybrid materials. Silsesquioxanes are a class of sol-gels prepared by the hydrolysis and subsequent condensation of trialkoxysilanes. Applications of these materials include scratch resistant coatings on acrylic or polycarbonate eye glass lenses. One commercially available sol-gel material useful in the elements of this invention is "Ultrashield." Methylsilsesquioxane is preferred in these applications since it forms the hardest coatings. Methylsilsesquioxanes have also been used as overcoats to extend the life of organic photoconductive elements, with the thickness of the methylsilsequioxane layer being 1–10 $\mu$m, preferably 2–5 $\mu$m. A mix of silanes also may be used to optimize the final properties of the sol-gel layer. For example, methyltrimethoxysilane is used to increase hardness for better scratch resistance, propyltrimethoxysilane is used to increase flexibility and minimize cracking, glycidoxypropyltrimethoxysilane is used to increase bulk conductivity, aminopropyltrimethoxysilane is used to catalyze the overcoat cure/cross-linking reaction. The protective overcoat typically has a resistivity from about $1\times10^{10}$ to about $1\times10^{17}$ ohm-cm, preferably $1\times10^{12}$ to $1\times10^{17}$ ohm-cm, with a $T^2$-silicon to $T^3$-silicon ratio of less than 1 to 1, and a ratio of carbon atoms to silicon atoms of greater than about 1.2 to 1. It is preferred that the thickness of the sol-gel layer or the combination of all sol-gel layers in the protective overcoat be between 1 and 10 $\mu$m, preferably between 2 and 5 $\mu$m.

The outermost layer of the protective overcoat is a DLC layer. The DLC layer is also known as an amorphous carbon layer or a plasma-polymerized amorphous carbon layer. When fluorine is included in the DLC layer, the layer also may be called a fluorinated diamond-like carbon (F-DLC), fluorinated amorphous carbon, or plasma-polymerized fluorocarbon layer. The DLC layer is preferably formed by plasma-enhanced chemical vapor deposition (PE-CVD) using an alternating current (AC) or direct current (DC) power source. The AC supply preferably operates in the radio or microwave frequency range. Selection of PE-CVD processing parameters, such as power source type or frequency, system pressure, feed gas flow rates, inert diluent gas addition, substrate temperature, and reactor configuration, to optimize product properties is well known in the art. The DLC layer may comprise a single layer having a uniform composition or one or more multiple layers of nonuniform compositions; however, it is preferred that the DLC layer is a single layer having a uniform composition. Further, the DLC layer can be formed by a single or multiple passes through, for example, the PE-CVD apparatus or reactor; however, it is preferred that the DLC layer is formed by a single pass through the PE-CVD apparatus or reactor. PE-CVD reactors are commercially available from, for example, PlasmaTherm, Inc.

The fluorine content of the DLC layer can be between 0 and 65 atomic percent, preferably between 0 and 40 atomic percent, more preferably 0 and 20 atomic percent, most preferably less than 5 atomic percent, based on the composition of the DLC layer. Layers formed using plasma-assisted methods tend to be highly crosslinked films that do not exhibit long range order or a characteristic repeat unit like conventional polymers.

As noted, the atomic percent of fluorine in the DLC layer can be between 0 and 65 atomic percent. The atomic percent of fluorine in the DLC layer can be determined using X-Ray Photoelectron Spectroscopy (XPS). This is a well known technique for analyzing the composition of thin films. A typical measurement is described in detail in Example 1.

Feed gases that are preferred to be used to prepare the plasma-polymerized coatings, that is, the DLC layer, used in this invention include sources of carbon.

Sources of carbon include hydrocarbon compounds. The preferred hydrocarbon compounds include paraffinic hydrocarbons represented by the formula $C_nH_{2n+2}$, where n is 1 to 10, preferably 1 to 4; olefinic hydrocarbons represented by formula $C_nH_{2n}$, where n is 2 to 10, preferably from 2 to 4; acetylenic hydrocarbons represented by $C_nH_{2n-2}$, where n is 2 to 10, preferably 2; alicyclic hydrocarbons; aromatic compounds; and organic substituted compounds thereof. This list includes, but is not limited to, the following: methane, ethane, propane, butane, pentane, hexane, heptane, octane, isobutane, isopentane, neopentane, isohexane, neohexane, dimethylbutane, methylhexane, ethylpentane, dimethylpentane, tributane, methylheptane, dimethylhexane, trimethylpentane, isononane and the like; ethylene, propylene, isobutylene, butene, pentene, methylbutene, heptene, tetramethylethylene, hexene, octene, allene, methyl-allene, butadiene, pentadiene, hexadiene, cyclopentadiene, ocimene, alloocimene, myrcene, hexatriene, acetylene, allylene, diacetylene, methylacetylene, butyne, pentyne, hexyne, heptyne, octyne, and the like; cyclopropane, cyclobutane, cyclopentane, cyclohexane, cycloheptane, cyclooctane, cyclopropene, cyclobutene, cyclopentene, cyclohexene, cycloheptene, cyclooctene, limonene, terpinolene, phellandrene, sylvestrene, thujene, carene, pinene, bornylene, camphene, tricyclene, bisabolene, zingiberene, curcumene, humalene, cadinenesesquibenihene, selinene, caryophyllene, santalene, cedrene, camphorene, phyllocladene, podocarprene, mirene, and the like; benzene, toluene, xylene, hemimellitene, pseudocumene, mesitylene, prehnitene, isodurene, durene, pentamethyl-benzene, hexamethylbenzene, ethylbenzene, propylbenzene, cumene, styrene, biphenyl, terphenyl, diphenylmethane, triphenylmethane, dibenzyl, stilbene, indene, naphthalene, tetralin, anthracene, phenanthrene, and the like. The hydrocarbon compounds need not always be in their gas phase at room temperature and atmospheric pressure, but can be in a liquid or solid phase insofar as they can be vaporized on melting, evaporation, or sublimation, for example, by heating or in a vacuum, in order to yield a gas phase of the hydrocarbon compound in the process reaction chamber.

The preferred feed gases used to prepare DLC layers containing fluorine would include sources of fluorine and carbon. Fluorocarbon compounds include but are not limited to paraffinic fluorocarbons represented by the formula $C_nF_xH_y$, where n is 1 to 10, preferably 2 to 4, x+y=2n+2, and x is 3 to 2n+2, preferably 2n+2; olefinic fluorocarbons represented by the formula $C_nF_xH_y$, where n is 2 to 10, preferably 2 to 4, x+y=2n, and x is 2 to 2n, preferably 2n; acetylenic fluorocarbons represented by $C_nF_xH_y$, where n is 2 to 10 preferably 2, x+y=2n−2, and x is 1 to 2n−2, preferably 2n−2; alkyl metal fluorides; aryl fluorides having from 6 to 14 carbon atoms; alicyclic fluorides, preferably perfluorinated alicyclic compounds, having from 3 to 8 carbon atoms, preferably from 3 to 6 carbon atoms; styrene fluorides; fluorine-substituted silanes; fluorinated ketones; fluorinated aldehydes; and organic substituted compounds thereof. These fluorocarbon feed compounds may have a branched structure. Examples include hexafluoroethane; tetrafluoroethylene; tetrafluoroethane; pentafluoroethane; octafluoropropane; 2H-heptafluoropropane; 1H-heptafluoropropane; hexafluoropropylene; 1,1,1,3,3,3-hexafluoropropane; 1,1,1,2,2,3-hexafluoropropane; 1,1,1,2,3,3-hexafluoropropane; 2-(trifluoromethyl)-1,1,1,3,3,3-hexafluoropropane; 3,3,3-trifluoropropyne; 1,1,1,3,3-pentafluoropropane; 1,1,1,3,3-pentafluoropropene; 1,1,1,2,2-pentafluoropropane; 3,3,3-trifluoropropyne; decafluorobutane; octafluorobutene; hexafluoro-2-butyne; 1,1,1,4,4,4-hexafluorobutane; 1,1,1,4,4,4-hexafluoro-2-butene; perfluoro(t-butyl)acetylene; dodecafluoropentane; decafluoropentene; 3,3,4,4,4-pentafluorobutene-1; perfluoroheptane; perfluoroheptene; perfluorohexane; 1H,1H,2H-perfluorohexene; perfluoro-2,3,5-trimethyl-hexene-2; perfluoro-2,3,5-trimethylhexene-3; perfluoro-2,4,5-trimethylhexene-2; 3,3,4,4,5,5,5-heptafluoro-1-pentene; perfluoro-2-methylpentane; perfluoro-2-methyl-2-pentene, perfluoro-4-methyl-2-pentene, hexafluoroacetone, perfluorobenzene, perfluorotoluene, perfluorostyrene, hexafluorosilane, dimethylaluminum fluoride, trimethyltin fluoride, and diethyltin difluoride. The fluorocarbon compounds need not always be in their gas phase at room temperature and atmospheric pressure, but can be in a liquid or solid phase insofar as they can be vaporized on melting, evaporation, or sublimation, for example, by heating or in a vacuum, in order to yield the fluorocarbon compound in its gas phase in the process reaction chamber.

Note that these fluorocarbon compounds can also serve as feed gases for producing non-fluorinated DLC coatings, assuming that changes in process conditions or in post-process treatment are used to ensure that no fluorine remains in the final coatings.

Paraffinic, fully fluorinated fluorocarbons and mixtures thereof are preferred. Olefinic or acetylinic hydrocarbons or mixtures thereof are preferred. Hydrogen is usually incorporated into the films in the form of the hydrogen present in the hydrocarbon feed gas. Pure hydrogen may also be used as an additional feed gas. Mixtures of two or more types of hydrocarbons can be used alone or with one or more fluorocarbon compounds. Mixtures of one or more fluorocarbons, one or more hydrocarbons, and hydrogen can be used.

The presence of hydrogen is not required but may be included without loss of desirable properties. Oxygen may also be incorporated into the films from the feed gas or from atmospheric oxygen gained through reaction with free radicals present in the coating as it is removed from the reactor.

Inert gases such as argon, helium, neon, xeon, or the like optionally may be fed into the reactor during the deposition of the protective layers in order to control the properties of the coating. The use of inert gases to control coating properties is well known to those skilled in the art.

The thickness of the DLC layer is preferably between about 0.05 and 2 $\mu$m, more preferably between about 0.05 and 0.5 $\mu$m, most preferably between about 0.15 and 0.35 $\mu$m. Thinner coatings tend not to form continuous films. Thicker coatings tend to contain high stress that results in spontaneous delamination of the DLC layer from the sol-gel layer.

The following examples are presented for a further understanding of the invention.

Photoconductive Element A

Photoconductive Element A was a negatively charging, multi-active photoconductive element not having a protective overcoat and was prepared as follows. First, the CGL was coated onto a 7 mil thick nickelized poly(ethylene terephthalate) support at a dry coverage of 6.57 g/m$^2$ (0.61 g/ft$^2$). The CGL coating mixture comprised 49.5 wt % polycarbonate (Lexan™ 145 available from General Electric Company), 2.5 wt % [poly(ethylene-co-2,2-dimethylpropylene terphthalate)], 39.25 wt % 1,1-bis-[4-(di-4-tolylamino)phenyl]cyclohexane, 0.75 wt % diphenylbis-(4-diethylaminophenyl)methane, 6.4 wt % 4-(4-dimethylaminophenyl)-2,6-diphenylthiapyrylium hexafluorophosphate, 1.6 wt % 4-(4-dimethylaminophenyl)-2-(4-ethoxyphenyl)-6-pheylthiapyryliumm flouoroborate, and 2.4 wt % of the aggregate "seed" (a dried paste of the above CGL mixture which had been previously prepared). The CGL mixture was prepared at 9 wt % in an 80/20 (wt/wt) mixture of dichloromethane and 1,1,2-trichloroethane. A coating surfactant, DC510 (Dow Corning Corporation), was added at a concentration of 0.01 wt % of the total CGL mixture.

The CTL having a p-type charge transport material was coated onto the CGL at a dry coverage of 13.72 g/m$^2$ (1.275 g/ft$^2$). The CTL mixture comprised 60 wt % poly[4,4'-(2-norbornylidene)bisphenol terephthalate-co-azelate-(60/40)], 19.75 wt % 1,1-bis-[4-(di-4-tolylamino)phenyl] cyclohexane, 19.5 wt % tri-(4-tolyl)amine, and 0.75 wt % diphenylbis-(4-diethylaminophenyl)methane. The CTL mixture was prepared at 10 wt % in a 70/30 (wt/wt) mixture of dichloromethane and methyl acetate. A coating surfactant, DC510 (Dow Corning), was added at a concentration of 0.024 wt % of the total CTL mixture.

Sol-gel layer A

A sol-gel formulation was prepared as follows. Glacial acetic acid was added dropwise to a previously prepared, stirred mixture of propyltrimethoxysilane, methyltrimethoxysilane and 3-glycidoxypropyltrimethoxysilane (in a weight ratio of 60/20/20 respectively), followed by dropwise addition of 3-aminopropyltrimethoxysilane. The acidified silanes were then hydrolyzed by dropwise addition of water. The following day, a previously acidified solution with glacial acidic acid of colloidal silica as a 30% solution in water was added dropwise to the clear solution. The reaction mixture was then diluted to approximately 20% solids by dropwise addition of ethanol and stirred in a covered vessel. After stirring for 3 weeks, coating aids, lubricants and a conductive material, LiI, were added to the clear solution.

Photoconductive Element A was coated with a methylmethacrylate adhesive subbing layer with thickness of 4 82 m, and the sol-gel formulation was then solvent coated onto the adhesive subbing layer. The sol-gel overcoated photoconductive element then was cured at 180° F. (82° C.) for 72 hours. The DLC overcoat was applied following the sol-gel curing step.

EXAMPLE 1

Protective overcoat of sol-gel and DLC with 0% fluorine

Photoconductive Element A, overcoated with Sol-Gel Layer A, was used as the substrate for deposition of the DLC layer of this example. A commercial parallel-plate plasma reactor (PlasmaTherm Model 730) was used for deposition of the DLC layer onto the substrate. The deposition chamber consisted of two 0.28 meter outer diameter electrodes, a grounded upper electrode and a powered lower electrode. The chamber walls were grounded, and the chamber is 0.38 meter in diameter. Removal of heat from the electrodes was accomplished via a fluid jacket. Four outlet ports (0.04 m$^3$), arranged 90° apart on a 0.33 meter-diameter circle on the lower wall of the reactor, lead the gases to a blower backed by a mechanical pump. A capacitance manometer monitored the chamber pressure that was controlled by an exhaust valve and controller. A 600-W generator delivered radio-frequency (RF) power at 13.56 MHz through an automatic matching network to the reactor. The gases used in the deposition flowed radially outward from the perforated upper electrode in a showerhead configuration in the chamber. The substrate to which the DLC layer was to be applied was adhered to the lower electrode for deposition using an adhesive. The element was coated at room temperature.

The DLC layer was deposited onto the substrate by introducing 116 standard cubic centimeters per minute (sccm) argon and 32 sccm acetylene into the reactor. The reactor pressure and RF power were 13.2 Pa and 100 W, respectively. Deposition time was 4.7 minutes.

Thickness of the DLC Layer

Simultaneous deposition of the coating layer on a silicon wafer allowed measurement of coating thickness using UV/VIS reflectometry. The thickness is shown in Table 1.

Composition of the DLC Layer

The composition of the DLC layer of Example 1 was analyzed using X-ray photoelectron spectroscopy (XPS). The XPS spectra were obtained on a Physical Electronics 5601 photoelectron spectrometer with monochromatic A1 Kα X-rays (1486.6 eV). All spectra were referenced to the C 1s peak for neutral (aliphatic) carbon atoms, which was assigned a value of 284.6 eV. Spectra were taken at a 45° electron takeoff angle (ETOA) which corresponds to an analysis depth of about 5 nm. Note that XPS is unable to detect hydrogen. The XPS results are presented in Table 1.

Latent Image Spread

Latent image spread (LIS) of the photoconductive element of Example 1 was measured using the method described by D. S. Weiss, J. R. Cowdery, W. T. Ferrar, and R. H. Young, *Proceedings of IS&T's Eleventh International Congress on Advances in Non-Impact Printing Technologies* 1995, 57, at high relative humidity (70% relative humidity) conditions. This represents the most stringent test for detecting latent image spread.

The LIS measurement initially produces a square wave pattern in a plot of surface potential versus distance. For a photoconductive element experiencing LIS, as the image spreads, the corners of the square wave become rounded, and the width of the wave broadens. The width of the pattern is determined by drawing tangents to the sides of the wave and measuring the distance between the two tangents at the points where they intersect the baseline drawn between the unimaged portions of the wave. The width of the surface potential wave (image width) is measured as a function of time to determine LIS. The result corresponding to no latent image spread would be an invariant image width as a function of time. Lower image widths and no change in image width as a function of time or of humidity are the desired results. The results of this type of LIS measurement can be correlated with performance of the photoconductive element in an electrophotographic imaging machine. Results of the LIS measurements for Example 1 appears in Table 2.

Scratch resistance

The scratch resistance of the coated photoconductive element of Example 1 was determined by scratch testing. A 2.5 μm diameter diamond stylus was loaded with a 4 g load and dragged across the surface of the sample. The width of the scratch produced was measured using atomic force microscopy. Smaller scratch widths indicate greater scratch resistance. The widths reported are the average of three measurements. The results appear in Table 3.

EXAMPLE 2

Protective overcoat of sol-gel and DLC with 6% fluorine

The photoconductive element of this example was made as described for Example 1 except that the feed gases used in deposition of the DLC layer were 96 sccm argon, 8 sccm hexafluoroethane, and 24 sccm acetylene. The deposition time for the DLC layer was 5.1 min.

The thickness and composition of the DLC layer were measured as described in Example 1. The results are shown in Table 1. The LIS of the photoconductive element of Example 2 was measured as described in Example 1; the LIS results are shown in Table 2. The scratch resistance of the element of this example was determined as described in Example 1; the data are shown in Table 3.

EXAMPLE 3

Protective overcoat of sol-gel and DLC with 19% fluorine

The photoconductive element of this example was made as described for Example 1 except that the feed gases used in deposition of the DLC layer were 64 sccm argon, 16 sccm hexafluoroethane, and 16 sccm acetylene. The deposition time for the DLC layer was 4.8 min.

The thickness and composition of the DLC layer were measured as described in Example 1. The results are shown in Table 1. The LIS of the photoconductive element of Example 3 was measured as described in Example 1; the LIS results are shown in Table 2. The scratch resistance of the element of this example was determined as described in Example 1; the data are shown in Table 3.

EXAMPLE 4

Protective overcoat of sol-gel and DLC with 32% fluorine

The photoconductive element of this example was made as described for Example 1 except that the feed gases used in deposition of the DLC layer were 32 sccm argon, 24 sccm hexafluoroethane, and 8 sccm acetylene. The deposition time for the DLC layer was 3.6 min.

The thickness and composition of the DLC layer were measured as described in Example 1. The results are shown in Table 1. The LIS of the photoconductive element of Example 4 was measured as described in Example 1; the LIS results are shown in Table 2. The scratch resistance of the element of this example was determined as described in Example 1; the data are shown in Table 3.

EXAMPLE 5

Protective overcoat of sol-gel and DLC with 51% fluorine

The photoconductive element of this example was made as described for Example 1 except that the feed gases used in deposition of the DLC layer were 12.8 sccm argon, 28.8 sccm hexafluoroethane, and 3.2 sccm acetylene. The deposition time for the DLC layer was 3.3 min.

The thickness and composition of the DLC layer were measured as described in Example 1. The results are shown in Table 1. The LIS of the photoconductive element of Example 5 was measured as described in Example 1; the LIS results are shown in Table 2. The scratch resistance of the element of this example was determined as described in Example 1; the data are shown in Table 3.

COMPARATIVE EXAMPLE 1

Protective overcoat of sol-gel alone

Comparative Example 1 consists of Photoconductive Element A with a protective overcoat of Sol-Gel Layer A. This photoconductive element was tested for LIS as described in Example 1, with the results shown in Table 2. The element was also tested for scratch resistance with the results shown in Table 3.

COMPARATIVE EXAMPLE 2

Protective overcoat of DLC alone

Comparative Example 2 consists of Photoconductive Element A with a protective overcoat consisting of a single layer of DLC. The DLC layer was deposited as described in Example 1, except that the DLC layer was deposited directly onto the outermost active layer of Photoconductive Element A. There is no sol-gel layer in the element of this Comparative Example. The element was tested for scratch resistance with the results shown in Table 3.

Discussion of results

Protective overcoats consisting of a sol-gel layer and an outermost DLC or F-DLC layer are demonstrated in the Examples. Compositions of the outermost layer of 0% (DLC) to 51% fluorine are demonstrated (Table 1).

Sol-gel protective layers alone are known to give rise to LIS when they are used on photoconductive elements in high relative humidity environments. This is demonstrated for the particular sol-gel used in the Examples by Comparative Example 1. Comparative Example 1 consists of a photoconductive element having a protective overcoat of sol-gel alone and, as shown in the data of Table 2, this element displays very high LIS at high humidity. There is nothing in the art that teaches how to overcome this problem effectively. In particular, there is no mention in the art of the idea of combining a sol-gel layer with a DLC or F-DLC outermost layer to prepare a protective overcoat. As DLC or F-DLC layers are not known to prevent LIS, there is no motivation from the prior art to think the combination of a sol-gel layer with a DLC or F-DLC layer would provide an element with reduced LIS. However, we have shown through Examples 1–5 that the combination of a sol-gel layer with a DLC or F-DLC layer provides a protective overcoat that gives significantly less LIS.

The photoconductive elements of this invention, containing a multilayer protective overcoat, has surprising improved scratch resistance compared to prior art elements. As shown in Table 3, an element containing a protective overcoat composed of sol-gel alone gives a scratch width of 12.5 μm (Comparative Example 1); whereas, an element containing a protective overcoat of DLC alone gives a scratch width of 12.6 μm (Comparative Example 2). The equivalent results for these two overcoat gives no suggestion that combining these layers would give an improvement in scratch resistance. However, all the elements of this invention (Examples 1–5), containing a protective overcoat of a sol-gel layer and a DLC or F-DLC layer, have significantly greater scratch resistance (lower scratch widths) than either of the prior art elements (Comparative Examples 1 and 2), as shown in Table 3. It is clear from these data that the improvements in scratch resistance seen with the elements of this invention could not have been predicted based on the prior art. Further, it is clear that the prior art provides no motivation for combining a sol-gel layer with a DLC or F-DLC layer to provide a protective overcoat on a photoconductive element that has improved properties.

TABLE 1

Characteristics of DLC and F-DLC Layers

| Example | Fluorinated Feed Gas (%) | DLC/F-DLC Thickness (μm) | Surface Composition from XPS C (%) | F (%) | O (%) | Si (%) | N (%) |
|---|---|---|---|---|---|---|---|
| 1 | 0 | 0.21 | 90 | 0 | 9 | 1 | 0 |
| 2 | 25 | 0.22 | 85 | 6 | 8 | 0 | 0 |
| 3 | 50 | 0.17 | 74 | 19 | 7 | 0 | 0 |
| 4 | 75 | 0.16 | 62 | 32 | 6 | 0 | 0 |
| 5 | 90 | 0.16 | 77 | 51 | 2 | 0 | 0 |

TABLE 2

Latent Image Spread at High Relative Humidity

| Time (sec) | Image width (mm) Example 1 | Example 2 | Example 3 | Example 4 | Example 5 | Comparative Example 1 |
|---|---|---|---|---|---|---|
| 5 | 2.97 | 2.97 | 2.99 | 2.99 | 2.94 | 3.12 |
| 30 | 3.14 | 3.03 | 3.06 | 3.08 | 3.17 | 3.64 |
| 60 | 3.32 | 3.09 | 3.12 | 3.18 | 3.28 | 4.02 |
| 150 | 3.68 | 3.24 | 3.26 | 3.33 | 3.56 | 4.69 |
| 300 | 4.13 | 3.43 | 3.47 | 3.61 | 3.76 | 5.49 |
| 600 | 4.65 | 3.68 | 3.78 | 3.95 | 4.1 | 6.47 |
| 1200 | 5.23 | 4.22 | 4.33 | 4.39 | 4.59 | 7.76 |
| 1800 | 5.54 | 4.59 | 4.55 | 4.67 | 4.9 | 8.41 |
| Totalwidthchange: | 2.57 mm | 1.62 mm | 1.56 mm | 1.68 mm | 1.96 mm | 5.29 mm |

TABLE 3

Scratch Testing Results

| Example or Comparative Example | Scratch width (μm) |
|---|---|
| Example 1 | 10.3 |
| Example 2 | 10.7 |
| Example 3 | 10.8 |
| Example 4 | 10.7 |
| Example 5 | 11.1 |
| Comparative Example 1 | 12.5 |
| Comparative Example 2 | 12.6 |

What is claimed:

1. A photoconductive element comprising:

an electrically conductive base;

at least one active layer comprising an organic material, said at least one active layer being capable of charge generation and charge transport; and an outermost multilayer protective overcoat, comprising at least one sol-gel layer and at least one outermost diamond-like carbon layer comprising fluorine.

2. A photoconductive element according to claim 1 wherein the protective overcoat comprises one sol-gel layer and one outermost diamond-like carbon layer.

3. A photoconductive element according to claim 1 wherein the diamond-like carbon layer contains 0 to 65 atomic percent fluorine, based on the composition of the diamond-like carbon layer.

4. A photoconductive element according to claim 1 wherein the diamond-like carbon layer contains 0 and 40 atomic atomic percent fluorine, based on the composition of the diamond-like carbon layer.

5. A photoconductive element according to claim 1 wherein the diamond-like carbon layer contains 0 and 20 atomic atomic percent fluorine, based on the composition of the diamond-like carbon layer.

6. A photoconductive element according to claim 1 wherein the diamond-like carbon layer contains less than 5 atomic atomic percent fluorine, based on the composition of the diamond-like carbon layer.

7. A photoconductive element according to claim 1 wherein the diamond-like carbon layer has a thickness between 0.05 and 0.5 μm.

8. A photoconductive element according to claim 1 wherein the diamond-like carbon layer has a thickness between 0.15 and 0.35 μm.

9. A photoconductive element according to claim 1 wherein the combined thickness of all sol-gel layers in the protective overcoat is between 1 and 10 μm.

10. A photoconductive element according to claim 1 wherein the combined thickness of all sol-gel layers in the protective overcoat is between 2 and 5 μm.

11. A photoconductive element according to claim 1 wherein the active layer comprises at least one charge generation layer and at least one charge transport layer.

12. A photoconductive element according to claim 1 wherein the active layer is a single layer.

13. A photoconductive element according to claim 1 wherein the active layer comprises a charge generation material selected from the group consisting of dye-polymer aggregates, phthalocyanines, squaraines, perylenes, and azo-compounds.

14. A photoconductive element according to claim 1 wherein the active layer comprises a charge transport material selected from the group consisting of arylamines, arylalkanes, hydrazones, pyrazolines, diphenoquinones, charge-transfer complexes of poly(N-vinylcarbazole):2,4,7-trinitro-9-fluorenone, 2,4,7-trinitro-9-fluorenone, N-[p-(di-p-tolylamino)phenyl]-N'-(1,2-dimethylpropyl)-1,4,5,8-naphthalenetetracarboxylic diimide, N,N-bis (p-(di-p-tolylamino) phenyl)-1,4,5,8-naphthalenetetracarboxylic acid and combinations thereof.

15. A photoconductive element according to claim 1 wherein the active layer comprises a charge transport material selected from the group consisting of triphenylamine; tri-p-tolylamine; N-N'diphenyl-N,N'-bis(3-methylphenyl)-(1,1'-biphenyl)-4,4'diamine; 1,1-bis(di-4-tolylaminophenyl) cyclohexane; N,N',N",N'"-tetrakis(4-methylphenyl)-(1,1'-biphenyl)-4,4'-diamine; 4-(4-methoxystyryl)-4',4"-dimethoxytriphenylamine; N,N'-diphenyl-N,N'-di(m-tolyl)-p-benzidine; and combinations thereof.

16. A method of making a photoconductive element comprising the steps of:

forming on an electrically conductive base at least one active layer capable of charge generation and charge transport;

coating on said active layer an adhesive subbing layer;

coating on said adhesive subbing layer a sol-gel layer; curing said sol-gel layer; and contacting said sol-gel layer in a reaction chamber with a feed gas comprising at least one of a hydrocarbon compound or a fluorocarbon compound, wherein said compounds are in their gas phase, and decomposing said compounds in their gas phase by plasma-enhanced chemical vapor deposition thereby forming on said sol-gel layer a diamond-like carbon layer having fluorine.

17. The method according to claim 16 wherein the diamond-like carbon layer contains between 0 and 65 atomic percent fluorine based on the composition of the diamond-like carbon layer.

18. The method according to claim 16 wherein said hydrocarbon compound is selected from the group consisting of paraffinic hydrocarbons represented by the formula $C_nH_{2n+2}$, where n is 1 to 10; olefinic hydrocarbons represented by formula $C_nH_{2n}$, where n is 2 to 10; acetylenic hydrocarbons represented by $C_nH_{2n-2}$, where n is 2 to 10; alicyclic hydrocarbons; and aromatic compounds.

19. The method according to claim 16 wherein said fluorocarbon compound is selected from the group composed of paraffinic fluorocarbons represented by the formula $C_nF_xH_y$, where n is 1 to 10, x+y=2n+2, and x is 3 to 2n+2; olefinic fluorocarbons represented by the formula $C_nF_xH_y$, where n is 2 to 10, x+y=2n, and x is 2 to 2n; acetylenic fluorocarbons represented by $C_nF_xH_y$, where n is 2 to 10, x+y=2n−2, and x is 1 to 2n−2; alkyl metal fluorides; aryl fluorides; alicyclic fluorides; styrene fluorides; fluorine-substituted silanes; fluorinated ketones; and fluorinated aldehydes.

* * * * *